US006058966A

United States Patent [19]

Schütz

[11] Patent Number: 6,058,966

[45] Date of Patent: May 9, 2000

[54] PLASTIC SAFETY VALVE FOR CONTAINERS

[75] Inventor: Udo Schütz, Selters-Westerwald, Germany

[73] Assignee: Protechna S.A., Fribourg, Switzerland

[21] Appl. No.: 09/209,311

[22] Filed: Dec. 11, 1998

[30] Foreign Application Priority Data

Dec. 12, 1997 [DE] Germany ..... 197 55 205

[51] Int. Cl.[7] ..... F16K 17/19

[52] U.S. Cl. ..... 137/493.9; 137/550; 220/203.12; 220/203.13; 220/203.29; 251/127

[58] Field of Search ..... 220/203.12, 203.13, 220/203.28, 203.29; 137/493.9, 550; 251/127

[56] References Cited

U.S. PATENT DOCUMENTS

| | | | |
|---|---|---|---|
| 2,679,946 | 6/1954 | Friend | 137/493.9 |
| 3,497,395 | 2/1970 | Kohen . | |
| 4,016,904 | 4/1977 | Gordon | 137/493.9 |
| 4,109,674 | 8/1978 | Beale | 137/493.9 |
| 5,908,129 | 6/1999 | Schutz | 220/203.28 |

FOREIGN PATENT DOCUMENTS

| | | |
|---|---|---|
| 2501228 | 7/1975 | Germany . |
| 2600343 | 7/1977 | Germany . |
| 3019650 | 12/1980 | Germany . |
| 3815023 | 12/1988 | Germany . |
| 4115610 | 7/1992 | Germany . |

*Primary Examiner*—Stephen M. Hepperle
*Attorney, Agent, or Firm*—Friedrich Kueffner

[57] ABSTRACT

A plastic safety valve for containers, especially pallet containers with an internal container of plastic and an external jacket of metal for the transport and storage of liquids, is constructed as an automatic aerating and venting valve and is integrated into a lid or plug for sealing the filling and/or emptying opening or the aerating and/or venting opening of a container. The valve housing, which is constructed as a threaded plug and can be screwed into a corresponding threaded hole in a threaded cover or threaded plug, has a central hub supported by ribs, wherein the hub has a through-hole. The ribs extend outwardly in a star-like manner from the hub toward a ring-shaped shoulder. Air passage holes are formed between the ribs. An elastically constructed valve membrane of an aerating unit for opening and closing the air passage holes between the ribs is pushed from the inside onto the hub up to a shoulder of the hub. The valve membrane, which is constructed as a hat-shaped profile, is installed in the valve housing with the opening of the hat facing the ring-shaped shoulder of the valve housing, wherein, when the aerating unit is in the closed position, a ring-shaped edge of the membrane rests under pretension against the inside surface of the ring-shaped shoulder of the valve housing which forms a valve seat.

18 Claims, 2 Drawing Sheets

PLASTIC SAFETY VALVE FOR CONTAINERS

BACKGROUND OF THE INVENTION

1. Field of the Invention

The present invention relates to a plastic safety valve for containers, especially pallet containers with an internal container of plastic and an external jacket of metal for the transport and storage of liquids, the valve being constructed as an automatic aerating and venting valve and being integrated into a lid or plug for sealing the filling and/or emptying opening or the aerating and/or venting opening of a container.

2. Description of the Related Art

DE 25 01 228 A1 describes a sealing cap, intended for containers for liquid, which can be screwed onto the neck of a bung. A safety valve of the general type in question here is integrated into this cap to serve as an aerating and venting valve, which responds to positive and negative pressures in the container. A valve disk of elastic material is used in this safety valve; when the disk is first installed, it is put under a significant amount of pretension and thus assumes the form of a segment of a sphere. When this type of valve is used, there is the danger that fatigue phenomena affecting the valve disk material will cause leaks to form after prolonged periods of service.

SUMMARY OF THE INVENTION

The object of the invention is to develop a safety valve of the above-described type which meets the highest safety requirements.

In accordance with the present invention, the valve housing, which is constructed as a threaded plug and can be screwed into a corresponding threaded hole in a threaded cover or threaded plug, go has a central hub supported by ribs, wherein the hub has a through-hole. The ribs extend outwardly in a star-like manner from the hub toward a ring-shaped shoulder. Air passage holes are formed between the ribs. An elastically constructed valve membrane of an aerating unit for opening and closing the air passage holes between the ribs is pushed from the inside onto the hub up to a shoulder of the hub. The valve membrane, which is constructed as a hat-shaped profile, is installed in the valve housing with the opening of the hat facing the ring-shaped shoulder of the valve housing, wherein, when the aerating unit is in the closed position, a ring-shaped edge of the membrane rests under pretension against the inside surface of the ring-shaped shoulder of the valve housing which forms a valve seat. A venting unit is inserted into the outer end of the through-hole in the hub, wherein the venting unit has a valve plate of elastic material whose bottom side rests on an inwardly bevelled outer edge of the hub which forms a valve seat and is held in the through-hole of the hub. A surge cover is pressed onto the inner end of the hub, wherein an outer edge of the cover cooperates with the inner end of the valve housing so as to form a circumferential slot for the air entering the container when the aerating unit is open or for the air or gas escaping from the container when the venting unit is open, and wherein the surge cover simultaneously serves to fasten the valve membrane to the hub. Located between the valve membrane and the surge cover and arranged coaxially to the membrane and the cover, a surge disk with at least one through-hole for the air or gas is inserted in the valve housing, wherein the disk cooperates with the cover to form a labyrinth as protection for the valve membrane against surges of liquid intruding into the valve housing. Retaining segments in the form of retaining teeth for a sealing cap, which can be firmly clamped to the housing, are formed on the outer edge of the valve housing, wherein openings for the air entering the container through the aerating unit when the valve membrane is open and for air or gas escaping from the container through the venting unit when the valve plate is open are formed between the retaining segments and the sealing cap which protrudes outwardly.

The safety valve according to the invention is characterized by the highest functional reliability and satisfies the safety guidelines described above. In the case of pallet containers, it is the flexible internal plastic container which is equipped with the safety valve. Containers of this type have a nominal content of, for example, 1,250 liters, and a positive pressure, which can be regulated by the venting unit of the safety valve, can build up inside them; this pressure stabilizes the internal container and prevents the internal container from "breathing" during transport. Breathing is associated with forcible contact between the container walls and the external metal grid jacket or external sheet-metal jacket of the pallet container, which means that, by preventing breathing, it is also possible to prevent the internal container from developing leaks during transport.

The various features of novelty which characterize the invention are pointed out with particularity in the claims annexed to and forming a part of the disclosure. For a better understanding of the invention, its operating advantages, specific objects attained by its use, reference should be had to the following descriptive matter in which there are described preferred embodiments of the invention.

DESCRIPTION OF THE PREFERRED EMBODIMENTS

Figure 1:
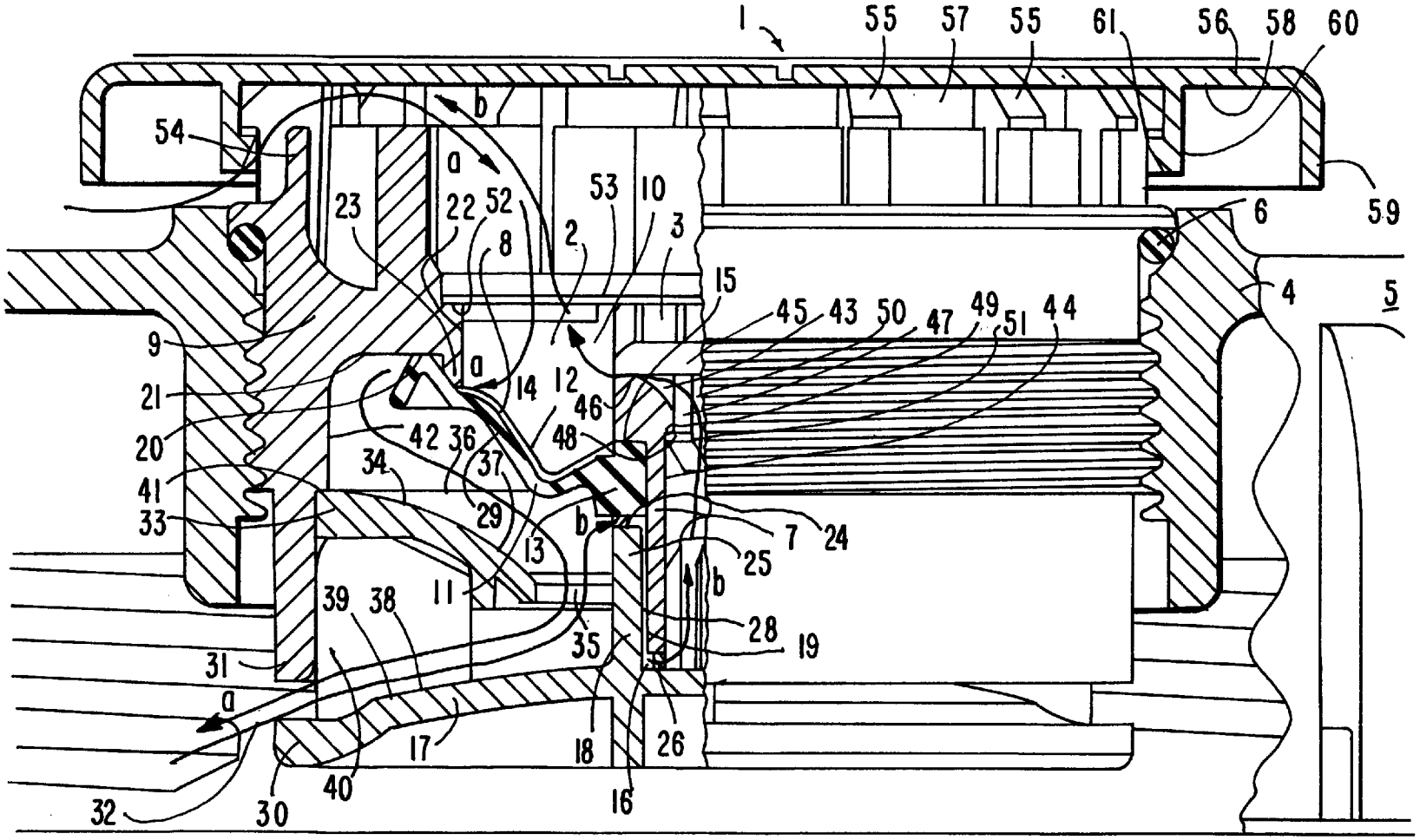
FIG. 1 is a longitudinal cross-sectional view of a safety valve, constructed as an aerating and venting valve, on an enlarged scale.
Figure 2:
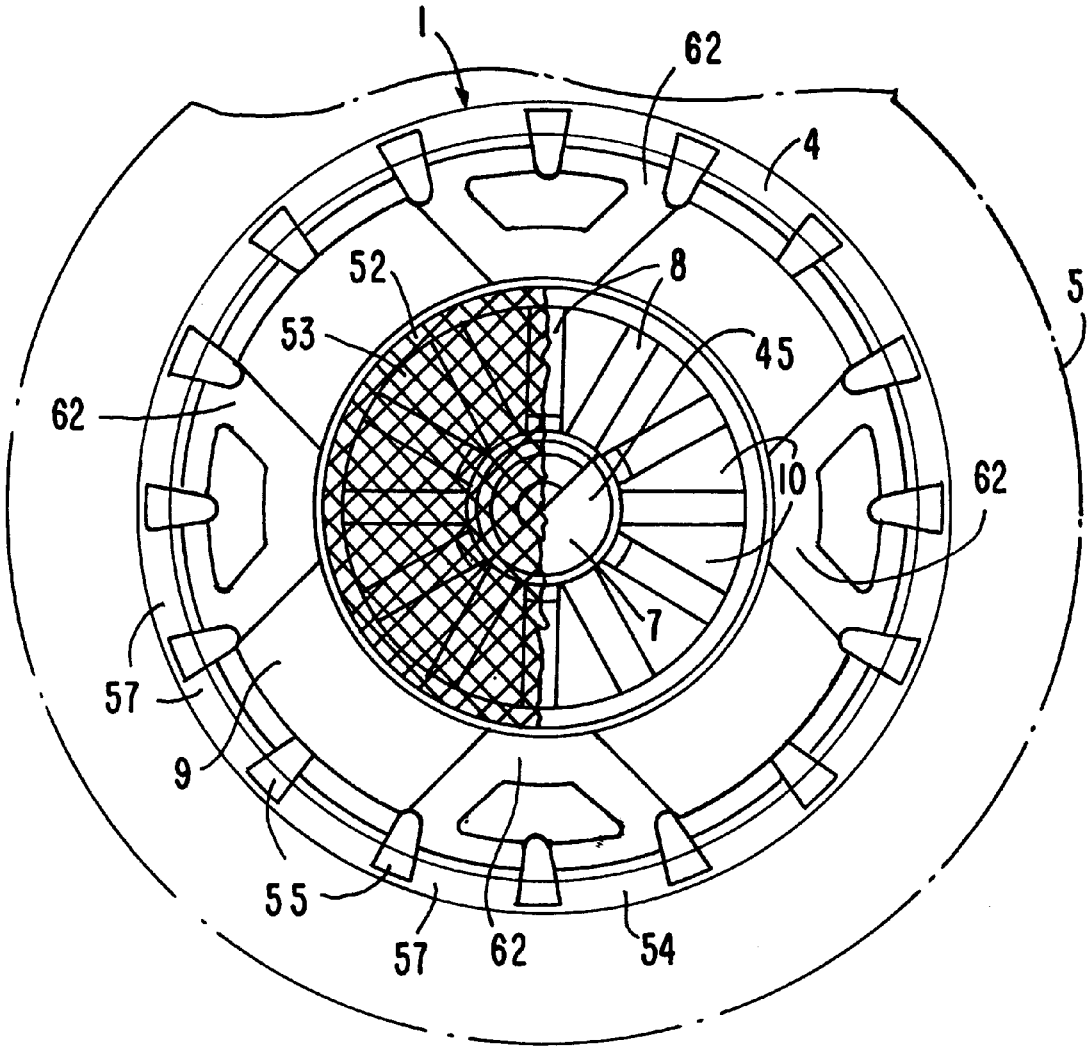
FIG. 2 is a top view onto the valve of FIG. 1 without its sealing cap.

The safety valve 1 according to FIGS. 1 and 2 for tanks, barrels, pallet containers, and similar containers for the transport and storage of liquids is made of plastic and includes an aerating unit 2 and a venting unit 3, which are integrated into a valve housing 4, which is itself designed as a threaded plug.

The valve housing 4 is screwed into a threaded plastic lid 5 used to seal the filling opening of the internal plastic container of a pallet container. The housing is sealed in the threaded lid 5 by a sealing ring 6. The housing has a central hub 7, supported by ribs 8, which extend out from the hub 7 in a star-like manner to a ring-shaped shoulder 9. Air holes 10 are formed between the support ribs 8.

An elastic valve membrane 11 of the aerating unit 2 for opening and closing the air holes 10 is made out of a flexible material resistant to aggressive fluids such as plastic or rubber with appropriate additives. This membrane is designed with the profile of a hat 12 and has a central, reinforced mounting hub 13. With the opening 14 of the hat pointing toward the ring-shaped shoulder 9 of the valve housing 4, the valve membrane 11 is pushed onto the hub 7 of the valve housing as far as a shoulder 15 on the housing.

The valve membrane 11 is held on the hub by a surge cover 17, which is pressed onto the inner end 16 of the hub 7. A clamping sleeve 18 with axial clamping webs 19 is molded onto the curved surge cover 17; these webs press the valve membrane 11 by its mounting hub 13 against the shoulder 15 of the hub 7 of the valve housing 4 in such a way that, when the aerating unit 2 is in its closed position, the valve membrane 11 rests by a ring-shaped edge 20 under pretension against the inside surface 21 of the ring-shaped shoulder 9 of the valve housing 4, which forms a valve seat. The valve membrane 11 is also supported by a ring-shaped web 23 molded onto the inside edge 22 of the ring-shaped shoulder 9. Flow channels 28 for the air or gas escaping under pressure from a container through the venting unit 3 are provided between the clamping sleeve 18 of the surge cover 17 and the hub 7 of the valve housing 4, these channels being connected to each other by through-slots 24 in the inner end 25 of the clamping sleeve 18 and through-slots 26 in the inner end 16 of the hub 7 of the valve housing 4.

The support ribs 8 of the hub 7 have a profile 29 which conforms to the hat-shaped profile 12 of the valve membrane 11 so that they can effectively support the valve membrane against positive pressure in the container.

The outer edge 30 of the surge cover 17 cooperates with the inner end 31 of the valve housing 4 to form a peripheral slot 32 for the air entering a container when the aerating unit 2 is open and for the air or gas escaping from a container when the venting unit 3 is open.

Between the valve membrane 11 and the surge cover 17, a surge disk 33 with a hat-shaped profile 34, coaxial to the membrane and the lid, is provided; this surge disk has a central opening 35 for air or gas. The surge disk 33 cooperates with the surge cover 17 to form a labyrinth, which protects the valve membrane 11 against surges of liquid entering the safety valve 1. The surge disk 33 is mounted in the valve housing 4 in such a way that the hat-shaped profile opening 36 faces the valve membrane 11 and forms a run-off surface 37 for the surging liquid which is entering the safety valve 1.

The curved surface of the surge cover 17 facing the valve membrane 11, further more, forms a run-off surface 38 for the surging liquid which has entered the safety valve 1.

Axial clamping tabs 40 are molded onto the outside surface 39 of the surge cover 17. Distributed around the periphery of the cover, they press the surge disk 33 against a shoulder 41 on the inside surface 42 of the valve housing 4.

The venting unit 3, inserted into the outer end 43 of the through-hole 44 in the hub 7 of the valve housing 4, is equipped with a valve plate 45 of elastic material. The bottom surface of this plate rests on the inward-beveled, outer edge 46 of the hub 7, which forms a valve seat. A mounting pin 47 with a head 48 is molded onto the valve plate 45 to form a single unit with it; this pin locks behind an under cut 49 in the through-hole 44 of the hub 7 to fasten the valve plate 45, which rests under slight pretension on the outer edge 46 of the hub 7. On the periphery of the mounting pin 47 and the head 48, continuous axial air or gas through-channels 50, 51 are provided.

A grid 53 of plastic is welded to the external surface 52 of the ring-shaped shoulder 9 of the valve housing 4. This grid covers the air holes 10 between the support ribs 8 of the hub 7 as protection against the intrusion of insects.

On the outer edge 54 of the valve housing 4, adjacent to the ring-shaped shoulder 9, hook-shaped retaining teeth 55 are provided to engage with a sealing cap 56, which can thus be clamped firmly to the housing. Openings 57 for the air flowing into a container when the aerating unit 2 of the safety valve 1 is open and for the air or gas flowing out of a container when the venting unit 3 is open are provided between the retaining teeth 55 and the sealing cap 56, which projects outward beyond the teeth. On the inside surface 58 of the sealing cap 56, a certain radial distance away from its outer edge 59, a ring-shaped web 60 with an undercut 61 is formed; when the sealing cap 56 is pressed down onto the valve housing 4, this undercut interlocks with the retaining teeth 55 of the housing.

Four molded segments 62 on the outside surface 52 of the ring-shaped shoulder 9 serve to accept a spider wrench for screwing the safety valve 1 into and out of the threaded lid 5.

When negative pressure develops, for example, in the internal plastic container of a pallet container equipped with the safety valve 1 as liquid is being removed, the valve membrane 11 of the aerating unit 2 opens, so that air can flow into the air throughopenings 55, 10, 35, 32 of the safety valve 1 in the direction of arrow a shown in FIG. 1.

The stiffness of the valve plate 45 of the venting unit 3 of the safety valve 1 is to be calculated in such a way that a positive pressure of, for example, 80 m bars, can build up in the internal container of the pallet container and thus stabilize the container. When the positive pressure in the container exceeds the cited limit, the valve plate 45 of the venting unit 3 of the safety valve 1 opens, so that the air or gas which is under positive pressure can escape from the container in the direction of arrow b through the air through-openings and flow channels 32, 35, 24, 28, 26, 44, 51, 50, 10, and 57 of the safety valve 1.

While specific embodiments of the invention have been described in detail to illustrate the inventive principles, it will be understood that the invention may be embodied otherwise without departing from such principles.

I claim:

1. A plastic safety valve for a container for the transport and storage of liquids, the valve being an automatic aerating and venting valve integrated into a cover or plug sealing a filling and/or emptying opening or an aerating and/or venting opening of the container, the safety valve comprising a valve housing comprised of a threaded plug and configured to be screwed into a matching threaded hole of the cover or plug, the valve housing comprising a central hub supported by ribs, the hub having a through-hole, the ribs extending outwardly in a star-like configuration from the hub toward a ring-shaped shoulder, air holes being formed between the ribs, an elastic valve membrane of an aerating unit for opening and closing the air holes being pushed from inside onto the hub up to a shoulder of the hub, the valve membrane having a hat-shaped profile being installed in the valve housing with an opening of the hat facing the ring-shaped shoulder of the valve housing, wherein, when the aerating unit is in a closed position, a ring-shaped edge of the membrane rests under pretension against an inside surface of the ring-shaped shoulder of the valve housing which forms a valve seat, a venting unit being inserted into an outer end of the through-hole in the hub, wherein the venting unit has a valve plate of elastic material having a bottom side resting against an inwardly bevelled outer edge of the hub forming a valve seat, the venting unit being held in the through-hole of the hub, a surge cover being pressed onto an inner end of the hub, wherein an outer edge of the surge cover forms together with an inner end of the valve housing a circumferential slot for air entering the container when the aerating unit is open or for the air or gas escaping from the container when the venting unit is open, the surge cover simultaneously being configured to fasten the valve membrane to the hub, a surge disk with at least one through-hole for air or gas being inserted into the valve housing between the valve membrane and the surge cover and extending coaxially to the membrane and the surge cover, wherein the surge disk forms together with the surge cover a labyrinth as a protection for the valve membrane against surges of liquid intruding into the valve housing, retaining segments for a sealing cap configured to be firmly clamped to the housing formed on an outer edge of the valve housing, wherein openings for the air entering the container through the aerating unit when the valve membrane is open and for the air or gas escaping from the container through the venting unit when the valve plate is open are formed between the retaining segments and the sealing cap protruding outwardly beyond the retaining segments.

2. The safety valve according to claim 1, wherein the support ribs of the hub comprise a profile conforming to the hat-shaped profile of the valve for supporting the valve membrane when a positive pressure prevails in the container, and wherein the valve membrane is supported by a ring-shaped web molded onto an inner edge of the ring-shaped shoulder of the valve housing.

3. The safety valve according to claim 1, wherein the valve membrane has a central reinforced mounting hub.

4. The safety valve according to claim 3, wherein the valve membrane is of a flexible material resistant to aggressive liquids.

5. The safety valve according to claim 4, wherein the flexible material resisting to aggressive liquids is a synthetic material or rubber with suitable additives.

6. The safety valve according to claim 1, wherein the clamping sleeve including axial clamping webs is molded onto a curved portion of the surge cover for pressing the mounting hub of the valve membrane against the shoulder of the hub of the valve housing, wherein, between the clamping sleeve of the surge cover and the hub of the valve housing, flow channels are formed for pressurized air and/or gas escaping from the container through the venting unit, wherein the flow channels are in communication with through-slits in the inner end of the clamping sleeve of the surge cover and through-slits in the inner end of the hub of the valve housing.

7. The safety valve according to claim 6, wherein the curved portion of the surge cover faces the valve membrane and forms a run-off surface for surges of liquid which have entered the safety valve.

8. The safety valve according to claim 1, wherein the surge disk has a hat-shaped profile with a central opening for air or gas.

9. The safety valve according to claim 1, further comprising clamping tabs molded onto the outside surface of the surge cover and distributed over the periphery of the cover, wherein the clamping tabs are configured to press the surge disk against a shoulder on the inner surface of the valve housing.

10. The safety valve according to claim 8, wherein the surge disk is mounted in the valve housing with the opening of the hat-shaped profile thereof facing the valve membrane so as to form a run-off surface for surges of liquid entering the valve.

11. The safety valve according to claim 1, comprising means for automatically controlling a positive pressure in the container by the venting unit.

12. The safety valve according to claim 11, wherein the means for automatically controlling the positie pressure is configured to control the pressure to 50–120 mbars.

13. The safety valve according to claim 11, wherein the means for automatically controlling the positive pressure is configured to control the pressure to 50–80 mbars.

14. The safety valve according to claim 1, wherein a mounting pin with a head is integrally formed on the valve plate of the venting unit, wherein the mounting pin engages behind an undercut of the through-hole of the hub so as to fasten the valve plate which rests under slight pretension against the outer edge of the hub of the valve housing, wherein axial air or gas channels in communication with each other are provided on a periphery of the mounting pin.

15. The safety valve according to claim 1, wherein a grid is attached to the outside surface of the ring-shaped shoulder of the valve housing, wherein the grid covers the air openings between the support ribs and the hub so as to protect against the intrusion of insects.

16. The safety valve according to claim 15, wherein the grid is of plastic material.

17. The safety valve according to claim 15, wherein the grid is welded to the outside surface of the ring-shaped shoulder.

18. The safety valve according to claim 1, wherein hook-shaped retaining teeth are formed on the outer edge of the valve housing for clamping the sealing cap, wherein on an inside surface of the sealing cap a ring-shaped web with an undercut is formed at a radial distance from the outer edge, wherein, when the sealing cap is clamped onto the valve housing, the ring-shaped web interlocks with the retaining teeth of the housing.

* * * * *